US011065179B2

(12) United States Patent
Baker

(10) Patent No.: US 11,065,179 B2
(45) Date of Patent: Jul. 20, 2021

(54) THERAPEUTIC POOL FLOTATION DEVICE AND THERAPEUTIC METHOD OF USE THEREOF

(71) Applicant: THE MAGIC BUTTT FLOAT COMPANY, INC., East Quogue, NY (US)

(72) Inventor: Arnold Beau Baker, East Quogue, NY (US)

( * ) Notice: Subject to any disclaimer, the term of this patent is extended or adjusted under 35 U.S.C. 154(b) by 62 days.

(21) Appl. No.: 16/277,219

(22) Filed: Feb. 15, 2019

(65) Prior Publication Data

US 2020/0261311 A1 Aug. 20, 2020

(51) Int. Cl.

| | |
|---|---|
| ***B63B 34/50*** | (2020.01) |
| ***A61H 37/00*** | (2006.01) |
| ***A63B 31/00*** | (2006.01) |
| ***B63B 34/00*** | (2020.01) |

(52) U.S. Cl.

CPC ..... *A61H 37/005* (2013.01); *A63B 31/00* (2013.01); *B63B 34/00* (2020.02); *A63B 2225/605* (2013.01); *B63B 34/50* (2020.02)

(58) Field of Classification Search

CPC ..... A61H 37/005; B63C 9/082; B63B 34/50; B63B 2225/605; A47C 15/006

USPC ..... D21/803, 809

See application file for complete search history.

(56) References Cited

U.S. PATENT DOCUMENTS

| | | | | |
|---|---|---|---|---|
| 6,056,613 | A * | 5/2000 | Pike | B63C 9/135 441/106 |
| 7,364,486 | B2 * | 4/2008 | Serpa | B63B 7/04 441/80 |
| 8,651,909 | B2 * | 2/2014 | Romzek | E02B 3/26 441/129 |
| 9,371,120 | B2 * | 6/2016 | Williams, Jr. | B63C 9/082 |
| 9,469,388 | B2 * | 10/2016 | Olshan | A63B 31/00 |
| 9,861,857 | B1 | 1/2018 | Godfrey et al. | |
| 2012/0018427 | A1 * | 1/2012 | Zemitis | A45C 7/00 220/4.28 |

(Continued)

OTHER PUBLICATIONS

TYR, https://www.amazon.com/TYR-Aquatic-Floatation-Belt-Size/dp/B0093SRMRO/ref=psdc_3419151_t1_B07DCL5HZY?th=1&psc=1 , Retrieved Jun. 20, 2020 (Year: 2013).*

(Continued)

*Primary Examiner* — Andrew Polay

(74) *Attorney, Agent, or Firm* — Mandelbaum Silfin Economou LLP; John S. Economou

(57) ABSTRACT

A therapeutic flotation device and a therapeutic method of use thereof is disclosed. The device includes a plurality of buoyant float elements and a member (an elongated web strap) that couples each of the buoyant float elements such that the buoyant float elements are serially aligned along the member. A first end of the member is secured to a second end of the member. A mating mechanism, such as a buckle, secures the first end of the member to the second end of the member, or the two ends of the member may be permanently secured to each other using an adhesive or by being sewn together. Each of the buoyant float elements has a center aperture aligned along the center of a cross-section thereof. The member is preferably coupled to each of the buoyant float elements by being sequentially passed through the center apertures of each buoyant float element.

12 Claims, 9 Drawing Sheets

(56) References Cited

U.S. PATENT DOCUMENTS

2014/0295720 A1* 10/2014 Wickham ..... B63C 9/08
441/84
2014/0308861 A1* 10/2014 Hanel ..... B63B 34/50
441/130

OTHER PUBLICATIONS

Thayer, "Start Pool Noodle Activities" published at https://teachingmama.org/star-pool-noodle-activities/, comments from Jun. 2018, retrieved Jan. 12, 2021 (Year: 2018).*

* cited by examiner

THERAPEUTIC POOL FLOTATION DEVICE AND THERAPEUTIC METHOD OF USE THEREOF

FIELD

This disclosure relates generally to a therapeutic pool floatation device and to a therapeutic method of use thereof.

BACKGROUND

A pool noodle is a flotation device usable in water, typically a pool. A pool noodle is typically formed of extruded foam, such as a polyethylene, polypropylene, or polyurethane foam. The extruded foam is cut to length, typically about 63 inches long and has a usual diameter of about 3 inches. A pool noodle often has a hollow bore extending through the center thereof. A pool noodle is highly buoyant and is often used for support by a swimmer in a pool. However, the size and shape of a single pool noodle makes it difficult to use in a pool when the user is at rest, even when considering its flexibility.

Relaxation therapies are typically done in salt water pools, with Epsom salt added to the water to allow a body to float at the surface of the pool without any aid or swimming action. Such relaxation therapies are done in specialized pools because of the large amount of Epsom salt required to make a body buoyant. A flotation tank that holds 200 gallons of water requires 850 pounds of Epsom salt for buoyancy. A 12 foot by 24 foot in ground swimming pool with an average depth of 5 feet will hold about 10,500 gallons of water—over 50 times as much as the flotation tank. The need for about 42,250 pounds of Epsom salt (50 times 850) to create buoyance makes it impractical to add the required amounts of Epsom salt to a conventional (indoor or outdoor) swimming pool. As a result, the owner or user of such pools are precluded from practicing such relaxation therapies in a swimming pool.

Accordingly, there is a need for an improved floatation device that allows one to practice relaxation therapies in a conventional swimming pool.

SUMMARY

In a first aspect, a therapeutic flotation device has a plurality of buoyant float elements and a member having a first end and a second end. The member couples each of the buoyant float elements such that the buoyant float elements are serially aligned along the member. The first end of the member is secured to the second end of the member.

In a further embodiment, a mating mechanism may secure the first end of the member to the second end of the member. The member may be an elongated web strap. The mating mechanism may be a buckle. The first end of the member may be permanently secured to the second end of the member using an adhesive. Alternatively, the first end of the member may be permanently secured to the second end of the member by sewing the first end of the member to the second end of the member. Each of the buoyant float elements may have a center aperture aligned along the center of a cross-section thereof. The member may be coupled to each of the buoyant float elements by being sequentially passed through the center apertures of each buoyant float element. The buoyant float elements may have a cross-section that is one of circular, triangular, rectangular, star-shaped, crescent-shaped, oval, and tear drop-shape. The center aperture may be aligned along a midpoint of the cross-section. The member may alternatively be coupled to each of the buoyant float elements by being secured to an exterior surface of each of the buoyant float elements.

In a second aspect, a method of providing a therapeutic flotation experience to a user of a flotation device is disclosed. The flotation device has a plurality of buoyant float elements, and a member having a first end and a second end. The member couples each of the buoyant float elements such that the buoyant float elements are serially aligned along the member. The first end of the member is secured to the second end of the member. The method comprises the steps of positioning the flotation device in a body of water and floating on the flotation device in the body of water.

The features, functions, and advantages that have been discussed can be achieved independently in various embodiments or may be combined in yet other embodiments, further details of which can be seen with reference to the following description and drawings.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

Figure 1:
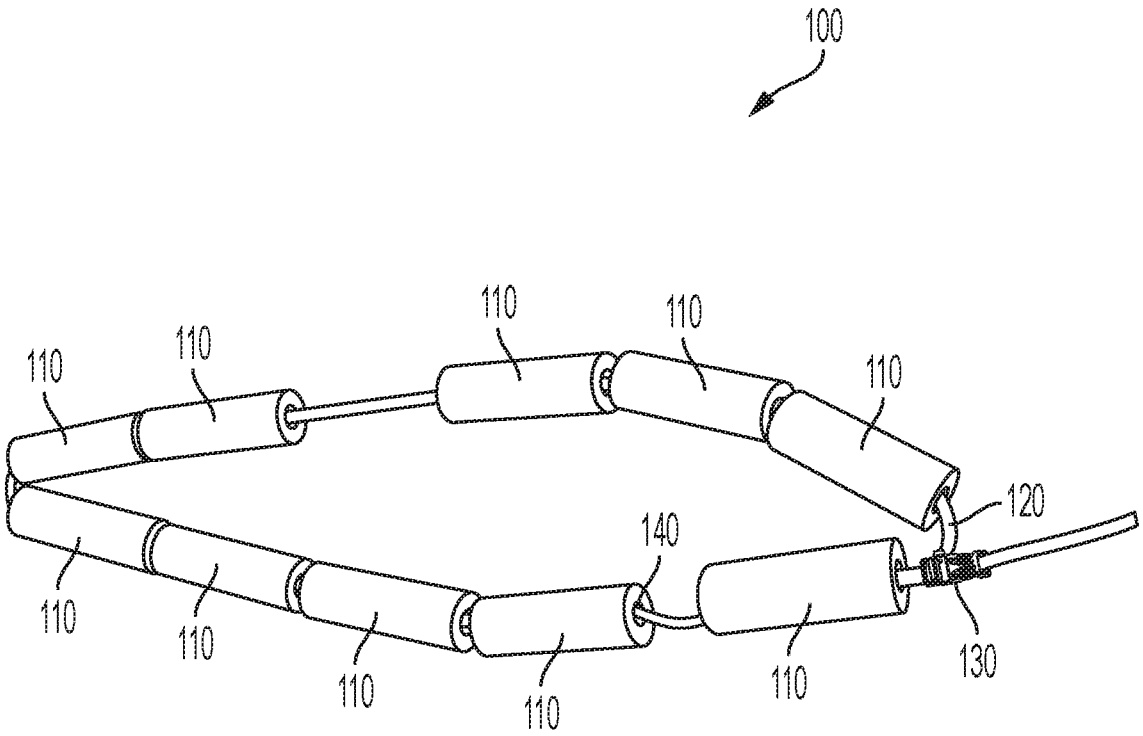
FIG. 1 is a diagram showing an embodiment of the flotation device according to the present disclosure.
Figure 4:
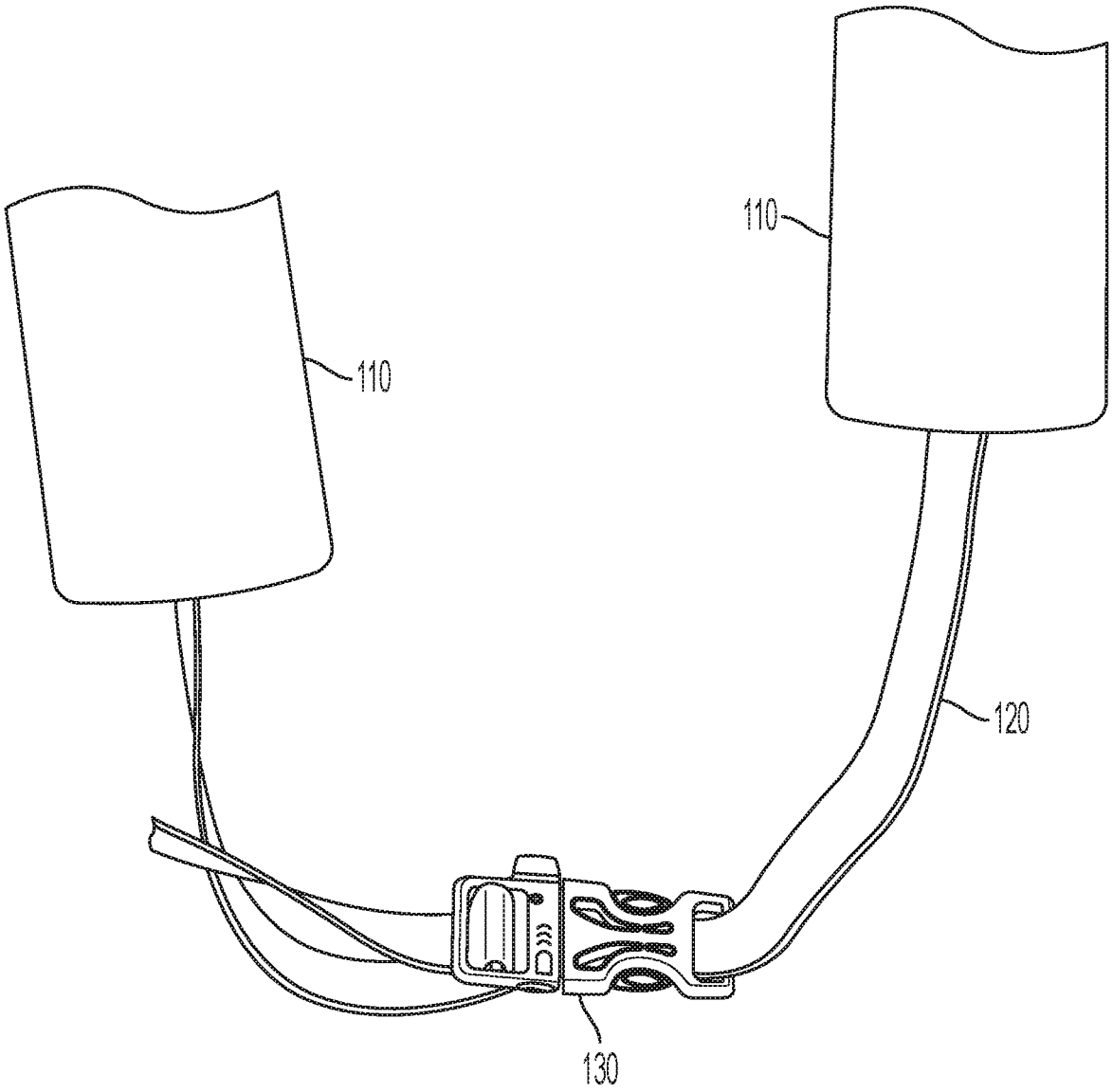
FIG. 4 is a diagram showing a close-up portion of the flotation device of the present disclosure.

The present disclosure describes a flotation device for use in relaxation therapies such as flotation therapy and sensory deprivation therapy, among others. In particular, referring now to FIG. 1, a flotation device 100 includes a plurality of buoyant float elements 110. Each float element 110 is preferably formed from a portion of a pool noodle and has a center aperture 140. Each float element 110 is preferably coupled to each other float element 110 via a member 120. Member 120 is preferably an elongated nylon web strap as shown in FIG. 1 and as known in the art, but in other embodiments may be any type of line/rope/cable/cord having opposite ends that can be secured together and which is not significantly non-buoyant (i.e., a non-buoyant metal chain would be inappropriate). In the presently preferred embodiment, member 120 is threaded through a center aperture 140 in each float element 110. In an alternative embodiment, each float element 110 may be solid, without any center aperture, and member 120 may be secured to an outer surface of each float element 110 via an adhesive or other conventional securing method (e.g., staples). In another alternative embodiment, member 120 consists of a plurality of separate segments, each segment having a first end secured to a first float element and a second end secured to a second float element, such that the plurality of float elements 110 are sequentially coupled as in the preferred embodiment. The two ends of strap 20 are preferably secured to each other with a mating mechanism 130. In the presently preferred embodiment, the mating mechanism 130 is a buckle for use with an elongated web-type strap. This type of mating mechanism 130 allows for the easy replacement of a damaged float element 110 and also allows flotation device 100 to be adjusted to accommodate larger (by adding one or more float elements 110) and smaller (by removing one or more float elements 110) users. A buckle acting as the mating mechanism 130 is shown in detail in FIG. 4. In an alternative embodiment where no adjustment or replacement is anticipated, the two ends of member 120 may be permanently secured together and mating mechanism 130 may be omitted. The two ends of member 120 may be sewn together or secured by way of an adhesive or a knot. Each float element 110 is approximately 6 inches long, and, in a presently preferred embodiment, flotation device 100 includes 10 float elements 110. The inventor has found that the use of float elements 110 formed from portions of a pool noodle provide an enhanced flotation experience as compared to the use of conventional pool noodle lengths. The inventor has found that an enjoyable buoyant experience is provided for an average-sized adult when member 120 is about 96 inches long, not including the loose end beyond the mating mechanism 130, when 10 float elements 110 are used which are on average 6 inches. This length for member 120 provides an appropriate spacing between float elements 110 to generate such buoyancy. Larger or smaller users may need to adjust the length of member 120 (and the number of float elements 110) during use, generally resulting in a ratio of about 3:2 for the member 120 to total float element 110 ratio.

In addition, while float elements 110 shown identically sized and shaped in FIG. 1, the float elements 110 may be of varied sizes and shapes. For example, instead of 10 circular cross-section members, the float elements 110 may include other cross-sectional shapes including, for example, triangular, rectangular, star-shaped, crescent-shaped, oval, and tear drop-shaped. All of the float elements 110 may be of a single cross-sectional shape or various combinations of different cross-sectional shapes may be provided. Further, some of the float elements 110 may have a length longer than 6 inches and others may have a length shorter than 6 inches. In general, however, the average length of all of the float elements 110 may be about 6 inches.

Figure 2:
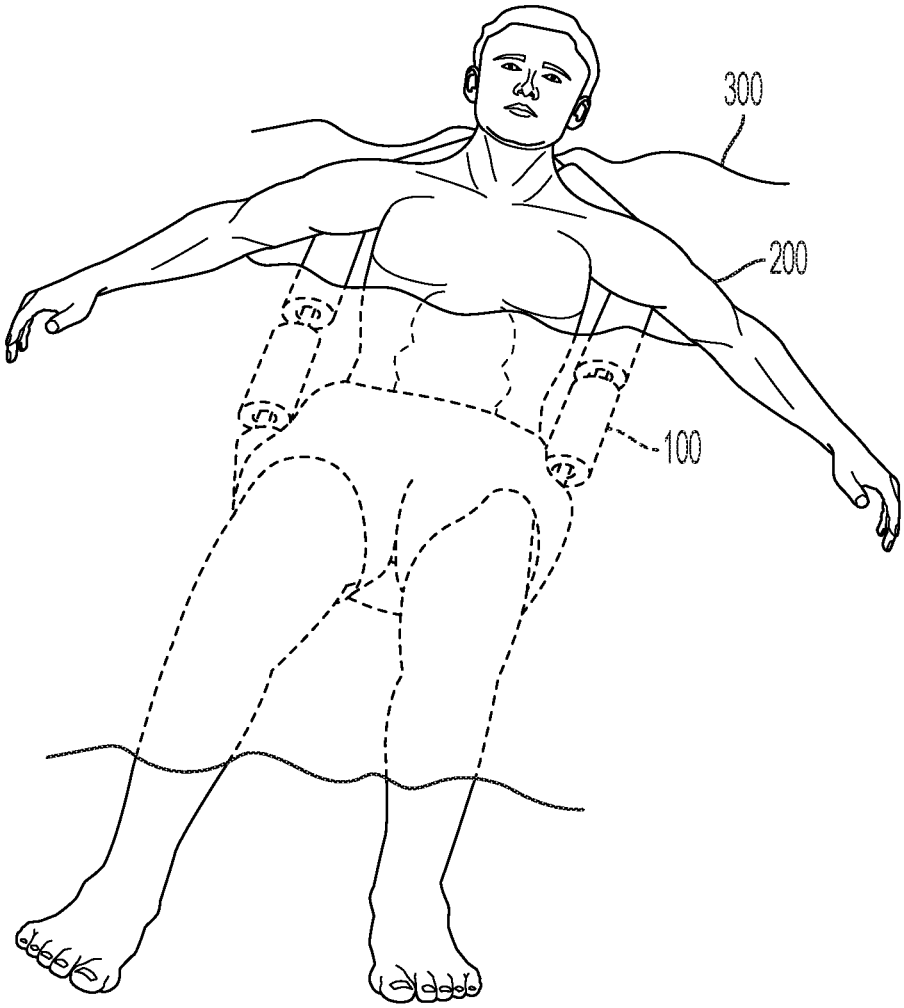
FIG. 2 is a diagram showing a first use of the flotation device of the present disclosure.

Flotation device 100 provides many ways to allow a person to float in water. For example, as shown in FIG. 2, a person 200 can position the flotation device 100 into an oval and then position their torso into the center position so that flotation device 100 supports the upper back, neck, head and legs of person 200, allowing such person 200 to float effortlessly in water 300. In another example, a person 200 can loop flotation device 100 around their body, with their head and legs above the flotation device 100 and their torso and arms below the flotation device 100, also allowing such person 200 to float effortlessly in the water.

Figure 3:
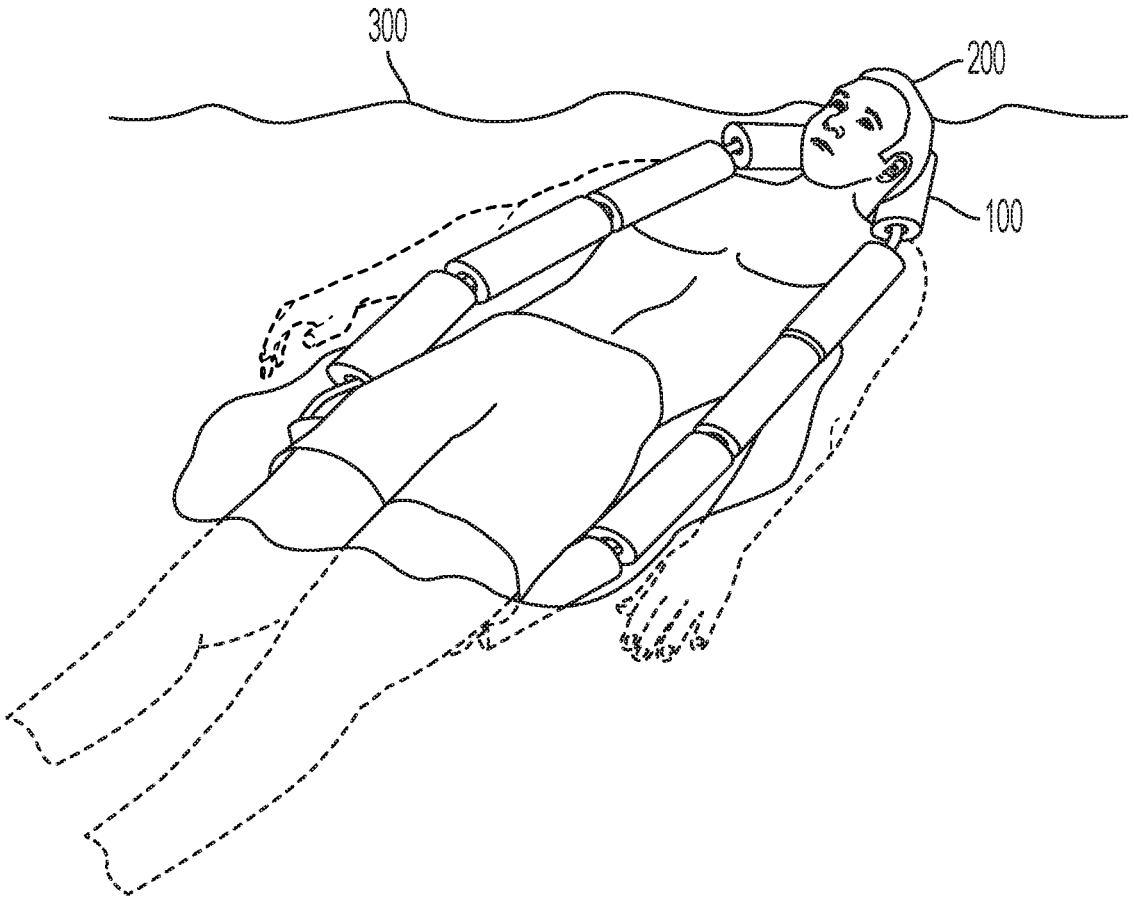
FIG. 3 is a diagram showing a second use of the flotation of the present disclosure.

As shown in FIGS. 2 and 3, a person 200 can position flotation device 100 in a manner which allows the person 200 to float without other aid or swimming action. That is, the person 200 can lie in the water 300 (e.g., a home swimming pool) and float without movement. By using flotation device 100, the person 200 can float without the need to add any Epsom salt to the pool. In addition, by closing their eyes or adding a blindfold, the person can have a complete or near complete lack of sensation while floating, in a manner much less expensive than purchasing a specialized salt water-based flotation device. The experience using flotation device 100 can allow the person's mind to relax to a state of meditation or clearness. Depending on the amount of time spent floating on the flotation device 100, the person may develop feelings of a disconnection from the outside world, enhancing the person's state of relaxation. The state of relaxation can be further enhanced by removing some or all electronic devices or outside environmental distractors from the pool location. This is more easily done when the swimming pool is indoors or remotely located. In some aspects, natural peaceful outdoor noises (e.g., birds, wind noise, running water, etc.) can also enhance the relaxation state.

Figure 5:
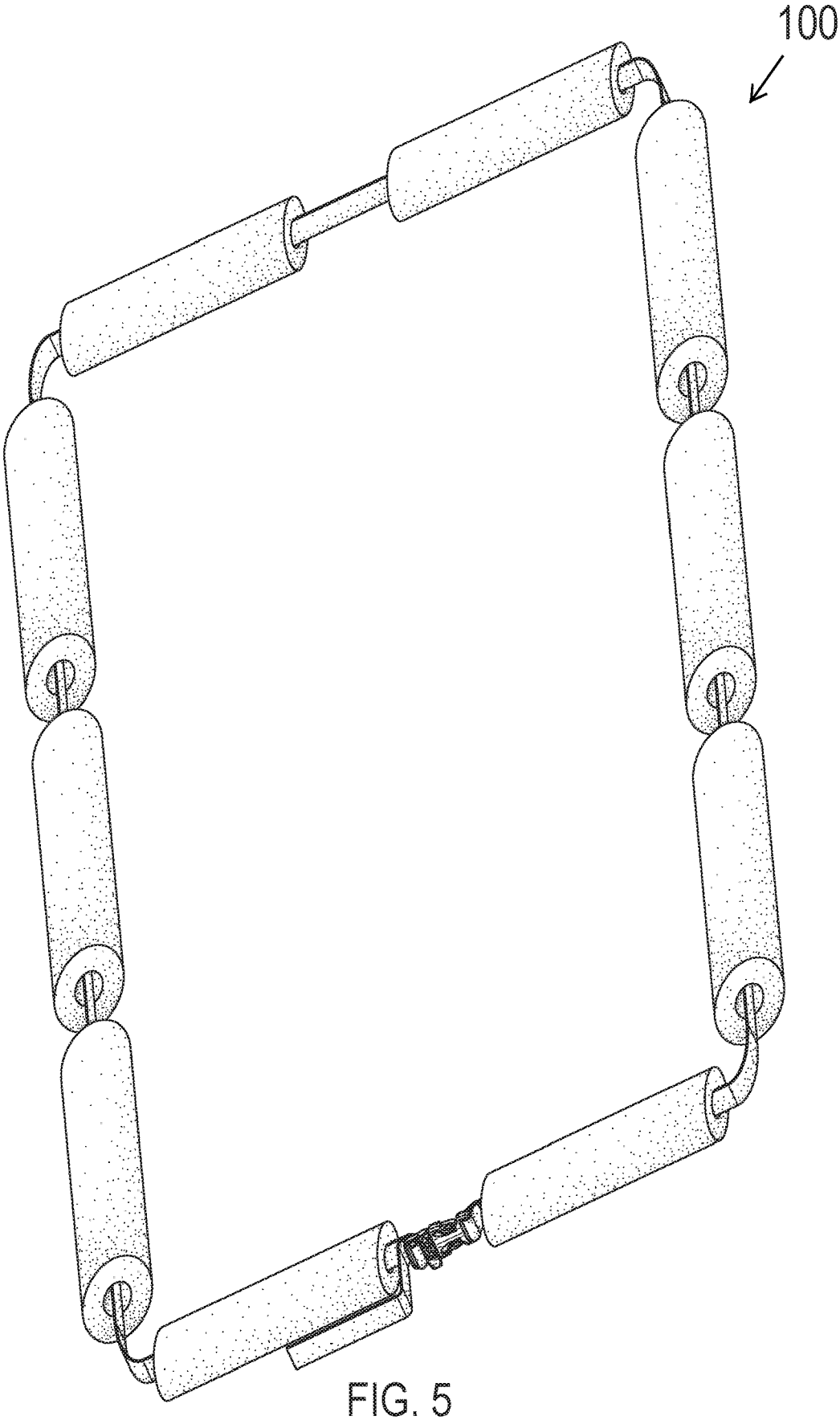
FIG. 5 is a is a perspective view of the flotation device of the present disclosure.
Figure 6:
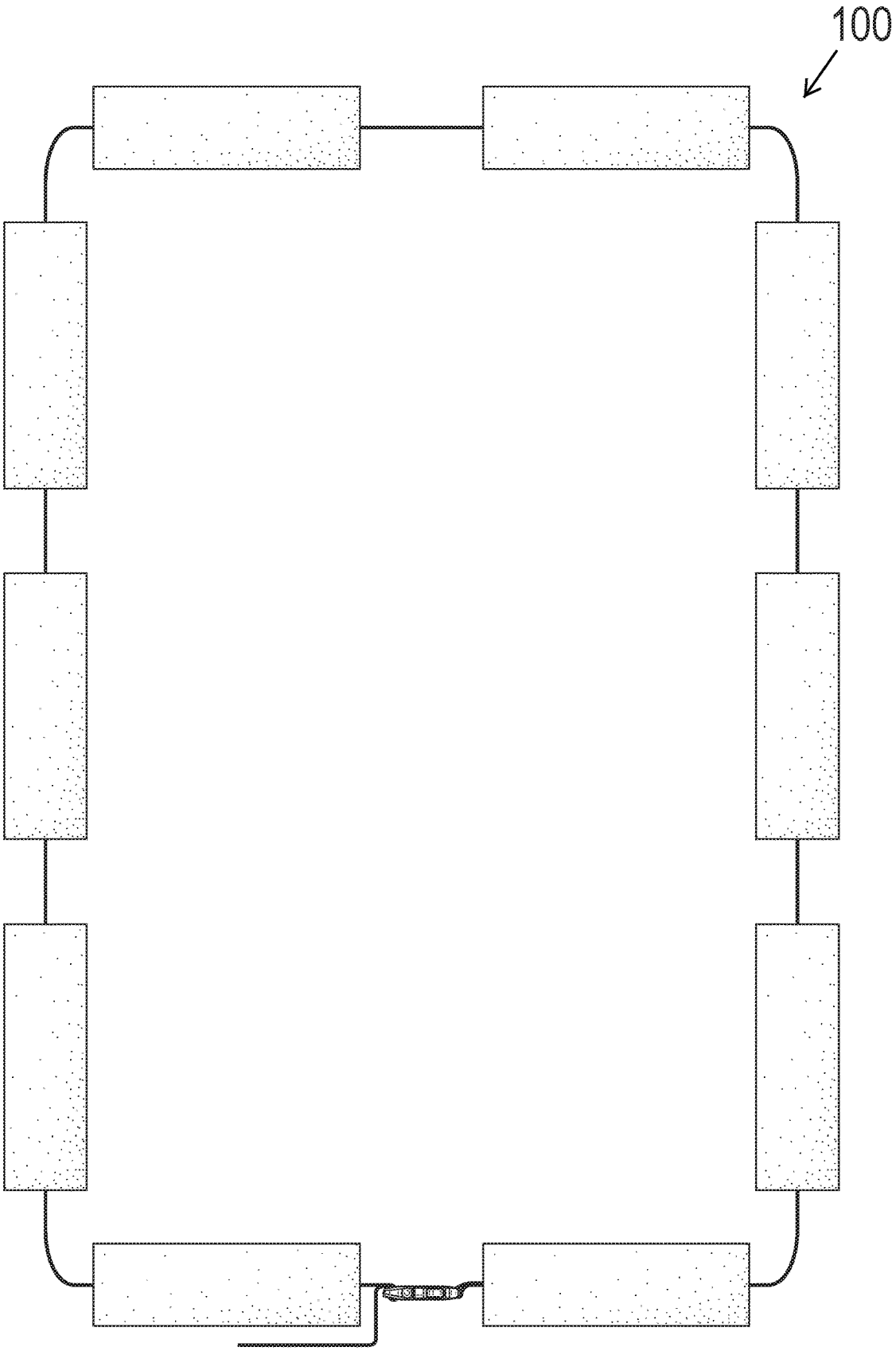
FIG. 6 is a top view of the flotation device of the present disclosure.
Figure 7:
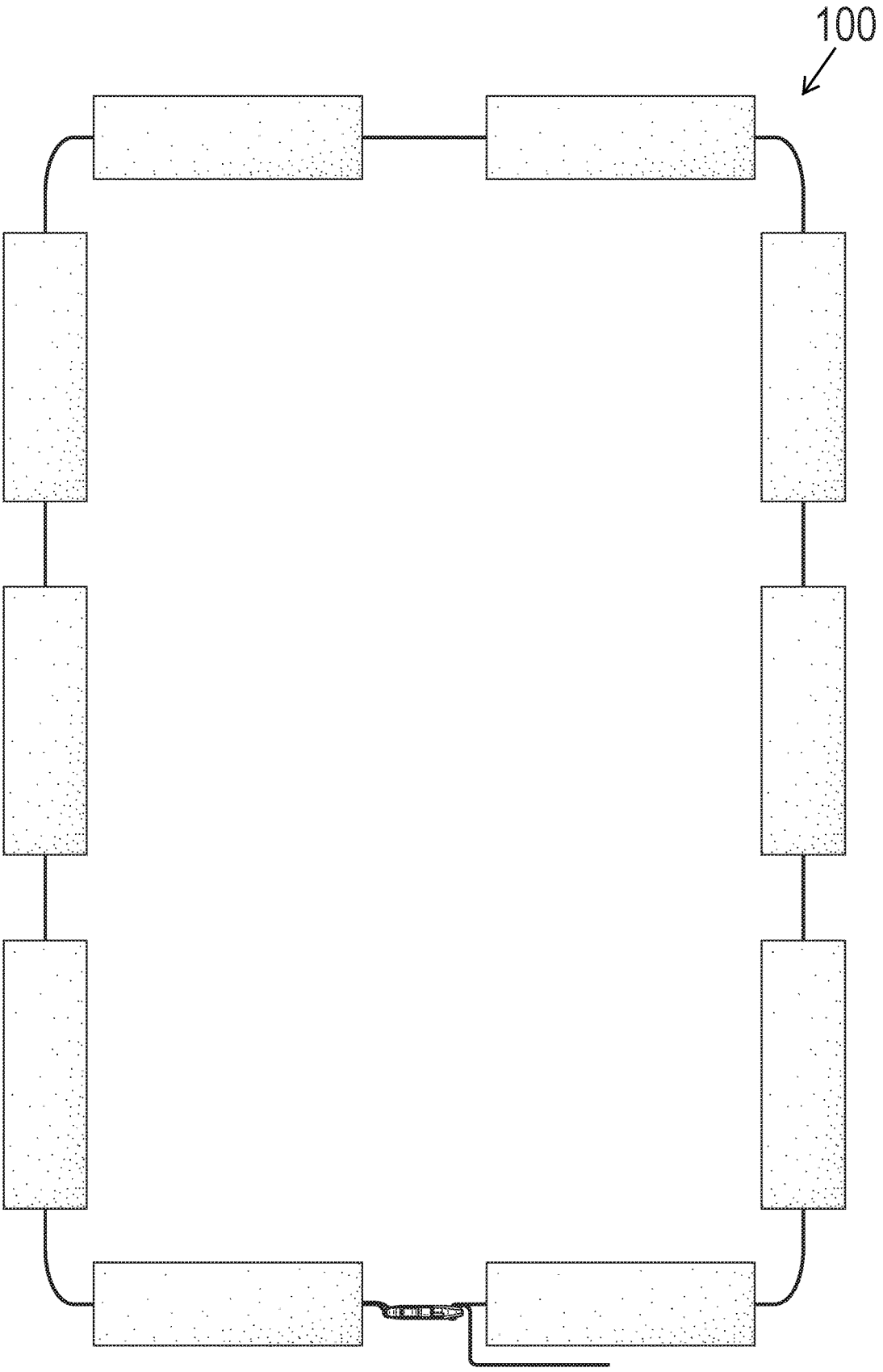
FIG. 7 is a bottom view of the flotation device of the present disclosure.
Figure 8:
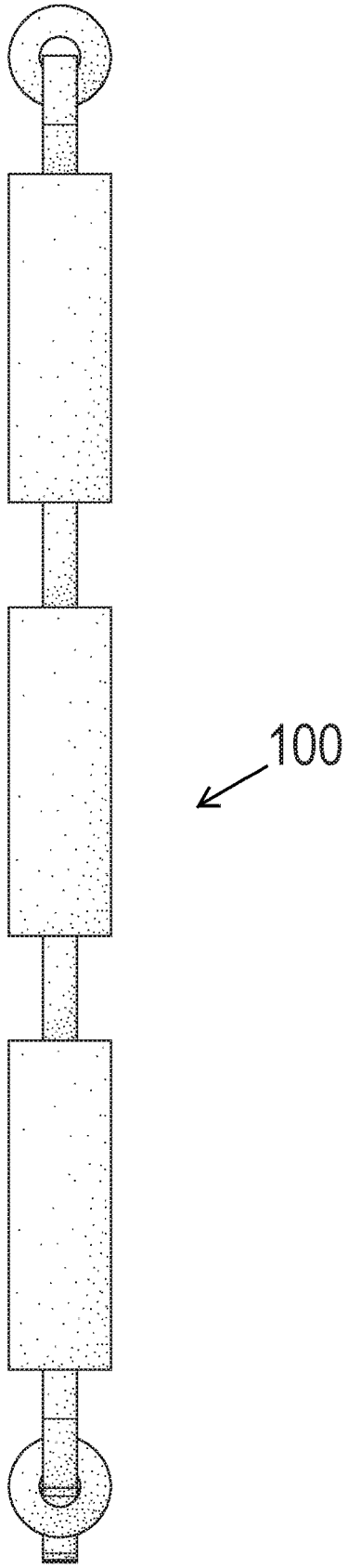
FIG. 8 is a right side view of the flotation device of the present disclosure.
Figure 9:
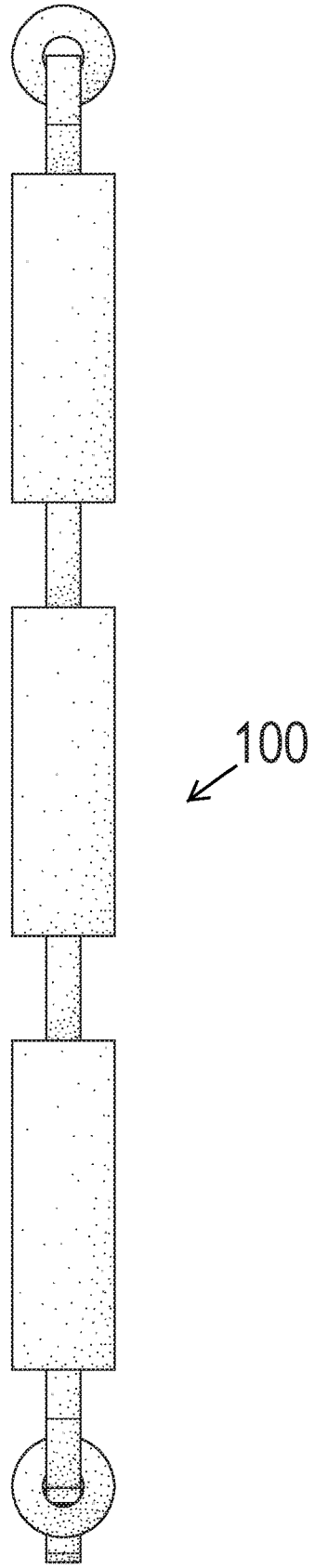
FIG. 9 is a left side view of the flotation device of the present disclosure.
Figure 10:
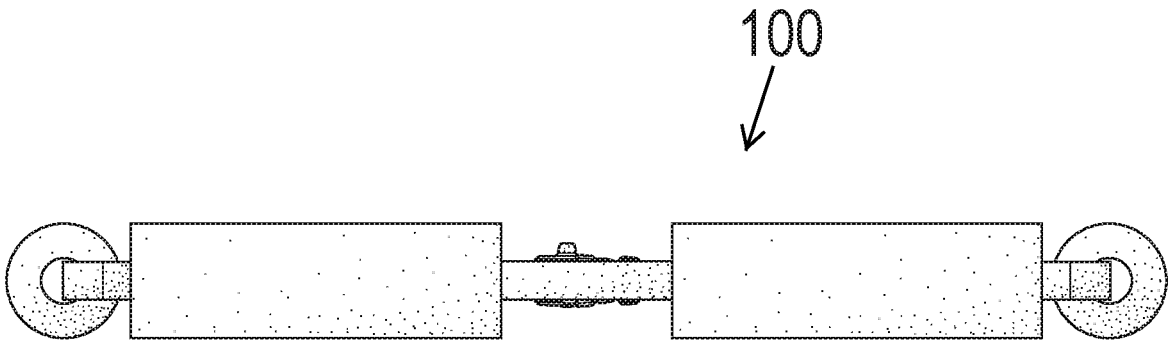
FIG. 10 is a rear view of the flotation device of the present disclosure; and, FIG. 11 is a front view of the flotation device of the present disclosure.
Figure 11:
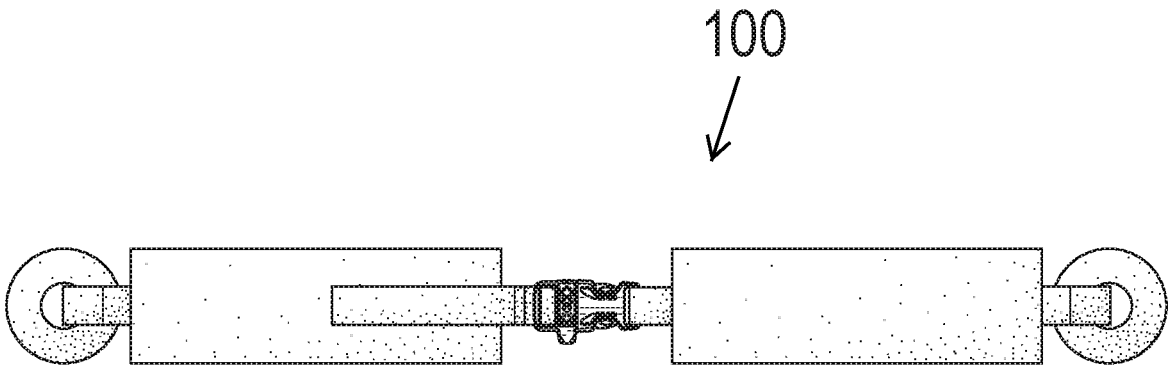

FIG. 5 is a perspective view of flotation device 100. FIG. 6 is a top view of flotation device 100. FIG. 7 is a bottom view of flotation device 100. FIG. 8 is a right side view of flotation device 100. FIG. 9 is a left side view of flotation device 100. FIG. 10 is a rear view of flotation device 100. FIG. 11 is a front view of the flotation device of the present disclosure.

In one embodiment, a user can use flotation device 110 for relaxation, meditation, sensory deprivation, or other floating use in a conventional swimming pool—essentially simulating a near-zero gravity environment. In particular, the present disclosure describes a method of providing a therapeutic flotation experience to a user of a flotation device. The flotation device has a plurality of buoyant float element. The device also has a member having a first end and a second end. The member couples each of the buoyant float elements such that the buoyant float elements are serially aligned along the member. The first end of the member is secured to the second end of the member. The method comprises the steps of positioning the flotation device in a body of water (such as a swimming pool) and floating on the flotation device in the body of water.

The water in the swimming pool may be heated to enhance the relaxation experience. After a period of time, the user may begin to feel weightless as if floating through space and a general stillness—allowing stresses and worries to lessen. After a session with flotation device 110, a user's physical body may feel light and energized, and prior pain may slowly fade as an inner peace grows. Flotation therapy with flotation device 110 may provide: diminished physical pain; accelerated healing; spinal decompression; stress relief; mental relaxation; enhanced creativity and learning; help with depression and anxiety; strengthened immune system; more restful; increased energy; enhanced mental focus; anger management; and deep meditation. Also, flotation therapy with flotation device 110 may be used to help treat or relieve symptoms of: arthritis, back pain, premenstrual tension, postpartum depression, asthma, migraine headaches, multiple sclerosis, cardiovascular conditions, osteoporosis, synovitis, and fibromyalgia. The use flotation device 110 may leave a user feeling disconnected and isolated from the normal world of perception. This experience can be very relaxing and therapeutic for the mind and presents a perfect meditation environment with the lack of any mental stimulus.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A therapeutic flotation device, comprising:

a plurality of buoyant float elements, each of the buoyant float elements having an aperture aligned along the center of a cross-section thereof, each of the buoyant float elements having a cross-section that is one of triangular, crescent-shaped, oval, and tear drop-shaped; and a flexible member having a first end and a second end, the flexible member coupling each of the buoyant float elements such that the buoyant float elements are serially aligned along the flexible member, the first end of the flexible member secured to the second end of the flexible member;

wherein the flexible member is coupled to each of the buoyant float elements by being sequentially passed through the apertures of each buoyant float element.

2. The therapeutic flotation device of claim 1, further comprising a mating mechanism for securing the first end of the flexible member to the second end of the flexible member.

3. The therapeutic flotation device of claim 2, wherein the flexible member is an elongated web strap.

4. The therapeutic flotation device of claim 3, wherein the mating mechanism is a buckle.

5. The therapeutic flotation device of claim 1, wherein the first end of the flexible member is permanently secured to the second end of the flexible member using an adhesive.

6. The therapeutic flotation device of claim 1, wherein the first end of the flexible member is permanently secured to the second end of the flexible member by sewing the first end of the flexible member to the second end of the flexible member.

7. A method of providing a therapeutic flotation experience to a user of a flotation device, the flotation device comprising a plurality of buoyant float elements, each of the buoyant float elements having an aperture aligned along the center of a cross-section thereof, a flexible member having a first end and a second end, the flexible member coupling each of the buoyant float elements such that the buoyant float elements are serially aligned along the flexible member, the first end of the flexible member secured to the second end of the flexible member, wherein the flexible member is coupled to each of the buoyant float elements by being sequentially passed through the apertures of each buoyant float element, wherein the buoyant float elements having a cross-section that is one of triangular, crescent-shaped, oval, and tear drop-shaped, comprising the steps of:

positioning the flotation device in a body of water; and floating on the flotation device in the body of water.

8. The method of providing a therapeutic flotation experience to a user of a flotation device of claim 7, wherein the flotation device further consists of a mating mechanism for securing the first end of the flexible member to the second end of the flexible member.

9. The method of providing a therapeutic flotation experience to a user of a flotation device of claim 7, wherein the flexible member is an elongated web strap.

10. The method of providing a therapeutic flotation experience to a user of a flotation device of claim 8, wherein the mating mechanism is a buckle.

11. The method of providing a therapeutic flotation experience to a user of a flotation device of claim 7, wherein the first end of the flexible member is permanently secured to the second end of the flexible member using an adhesive.

12. The method of providing a therapeutic flotation experience to a user of a flotation device of claim 7, wherein the first end of the flexible member is permanently secured to the second end of the flexible member by sewing the first end of the flexible member to the second end of the flexible member.

* * * * *